United States Patent [19]

Goto et al.

[11] Patent Number: 4,925,827

[45] Date of Patent: May 15, 1990

[54] THERMOSENSITIVE RECORDING MATERIALS

[75] Inventors: Atsuo Goto; Naomasa Koike, both of Tsukuba, Japan

[73] Assignee: Mitsubishi Paper Mills Ltd., Tokyo, Japan

[21] Appl. No.: 345,857

[22] Filed: May 1, 1989

[30] Foreign Application Priority Data

May 12, 1988 [JP] Japan ..... 63-116052

[51] Int. Cl.[5] ..... B41M 5/18

[52] U.S. Cl. ..... 503/207; 427/152; 428/327; 428/342; 428/913; 503/226

[58] Field of Search ..... 503/200, 207, 226; 427/152, 150, 151; 428/323, 327, 340–342, 913, 914

[56] References Cited

U.S. PATENT DOCUMENTS 4,798,820 1/1989 Yaguchi et al. ..... 428/484

FOREIGN PATENT DOCUMENTS 5093 1/1984 Japan ..... 503/226

*Primary Examiner*—Pamela R. Schwartz

*Attorney, Agent, or Firm*—Cushman, Darby & Cushman

[57] ABSTRACT

A thermosensitive recording material bearing an undercoat layer comprising fine organic hollow particles having a specific ratio of its wall thickness to its particle diameter provides excellent thermal response and minimizes foreign matters adhered to a thermal head.

8 Claims, No Drawings

THERMOSENSITIVE RECORDING MATERIALS

FIELD OF THE INVENTION

The present invention relates to thermosensitive recording materials having excellent thermal response and having minimized tailings or foreign matters adhered to a thermal head.

DISCUSSION ON RELATED ART

Thermosensitive recording materials are generally composed of a support having provided thereon a thermosensitive recording layer containing as major constituents an ordinarily colorless or slightly colored dye precursor and an electron receptive developer. Upon being heated by means of a thermal head, thermal pen or laser beam, the dye precursor instantaneously reacts with the developer to form a recorded image, as disclosed in Japanese Patent Examined Publication Nos. 43-4160, 45-14039, etc. Because of the advantages of relatively simple design of devices, easy maintenance and making no noise, the recording devices employing such thermosensitive recording materials are being used in a wide field including recording instruments for measurements, facsimiles, printers, terminal devices for computers, labels, and automatic vending machines for railroad tickets and the like. Particularly in the field of facsimiles, demand for thermal sensitive mode has been greatly increasing and the performance of facsimiles has becoming high speed due to reduction in transmission costs. Facsimiles have reduced the cost and minimized the energy consumption. In response to such high speed and low energy performance required for facsimiles, high sensitivity has been demanded for thermosensitive recording materials. On the other hand, a dot density of thermal head was generally 8 lines/mn but has recently become a density as high as 16 lines/mn. In addition, a dot area has become small and, demands for printing small-sized characters in high image quality or printing characters with density gradation by Dither method have been increasing. Thus, good printability, namely, to obtain images faithfully reproduced from dots on a head has been much more demanded than ever.

Attempting to satisfy these requirements, adhesion between a recording sheet and a thermal head was improved by supercalendering to a strong degree but such a treatment resulted in defects of decreasing whiteness, i.e., so called background stain, and the like.

It is proposed in Japanese Patent Application KOKAI (Laid-Open) No. 56-27394 to provide an undercoat layer between a thermosensitive layer and the base paper. By the provision of an undercoat layer, high density images can be obtained in a small energy without any violent supercalendering and higher density can be achieved than before. It is believed that the provision of this undercoat layer would be effective for rendering the surface of a thermosensitive layer after coated smooth by filling up unevenness of a support to provide a smooth surface.

As described above, by the provision of undercoat layer, the higher density recording has been progressed than before. However, demands for much higher density recording and more improvement in the dot reproducibility in recent years cannot be coped simply with the provision of undercoat layer merely aiming at smoothening the surface.

SUMMARY OF THE INVENTION

An object of the present invention is to provide thermosensitive recording materials having good thermal response and good dot reproducibility in response to requirements for higher sensitivity and improving dot reproducibility which could not be solved by the foregoing techniques as described above.

The present inventors have discovered that by coating a composition comprising fine organic hollow particles having a ratio of its wall thickness to its particle diameter being not greater than 0.15 and an oil-absorbing inorganic pigment as an undercoat layer provided between a support and a thermosensitive layer and have accomplished the present invention.

According to the present invention, there is provided a thermosensitive recording material comprising a support having provided thereon a thermosensitive recording layer comprising a dye precursor and a color developer capable of developing a color of said dye precursor upon heating and an undercoat layer comprising fine organic hollow particles showing a ratio of its wall thickness to a particle diameter being not greater than 0.15.

DETAILED DESCRIPTION OF THE PREFERRED EMBODIMENTS

That is, by providing an undercoat layer containing the aforesaid fine organic hollow particles having a ratio of a wall thickness to a particle diameter being 0.15 or less, it is effective to form smoother surface by filling up unevenness of the support like the case of an undercoat layer formed by coating a pigment alone; in addition to the effect, it is believed that due to heat insulating properties possessed by hollow particles, thermal energy supplied from a thermal head is prevented from radiating out of the system and hence, the thermal energy would be acted on the thermosensitive layer more effectively. It is further believed that adhesion between the surface of thermosensitive paper and a thermal head would be improved because of elasticity of the hollow particle layer and therefore, excellent dot reproducibility is exhibited. However, hollow particles having a ratio of its wall thickness to its particle diameter of being greater than 0.15 are considered to loose their sufficient heat-insulating properties and elasticity. Accordingly, the thermosensitive recording material having excellent thermal response which is the object of the present invention cannot be obtained.

The wall thickness of the hollow particles is generally in a range of from 0.5 to 10 μm and hence, the particle diameter of the hollow particles is appropriately chosen from the range of 0.075 to 1.5 μm.

Herein, the term particle diameter means an average diameter of the hollow particles.

The organic hollow particles used in the present invention are desirably those that are neither distorted nor ruptured by heat upon recording or pressure upon super-calendering, etc. Specifically, styrene resins, acryl resins or styrene-acryl copolymer resins are preferably used but the organic hollow particles are not particularly limited thereto so long as they can meet the above-mentioned requirements.

It is preferred that the undercoat layer be formed into a dual layer. As a first layer, an undercoat layer comprising the fine hollow particles described above is provided and as a second layer, an oil-absorbing inorganic pigment is coated, whereby more effective results can be obtained.

In the first layer described above, it is also possible to incorporate other pigments in such an amount that does not interfere with the effect of the fine hollow particles. As such a pigment, mention may be made of a pigment ordinarily used for coating paper, etc., e.g., an organic pigment such as polyethylene, polystyrene, ethylene-vinyl acetate, urea-formaldehyde resin, etc.; diatomaceous earth, talc, kaolin, calcined kaolin, calcium carbonate, magnesium carbonate, titanium oxide, zinc oxide, silicon oxide, aluminum hydroxide, zinc hydroxide, barium sulfate, etc. They may be used singly or as admixture of two or more. An amount of the pigment described above to be used in combination is not particularly limited but preferably less than 50 wt % of the amount of the first layer.

Further in case that a thermosensitive recording layer is directly provided on the fine organic hollow particle layer, a color forming component melted by thermal energy from a thermal head is absorbed into the hollow particle layer and colored images are shielded, sometimes resulting in rather decreasing image density or adherence of foreign matters onto the thermal head or sticking upon printing. For these reasons, it is believed that the provision of the oil-absorbing inorganic pigment layer further onto the hollow particle layer as the second undercoat layer would not only prevent those defects but also act to render the surface smoother which was already smoothened by providing the first undercoat layer.

As the pigment used for the second undercoat layer of the present invention, those pigments generally used for coating paper, etc. can be used and are exemplified by calcium carbonate, kaolin, calcined kaolin, zinc oxide, titanium oxide, aluminum hydroxide, zinc hydroxide, barium sulfate, silicon oxide, etc. Of these, the pigments showing an oil absorbing amount of 70 ml/100 g or more, especially calcined kaolin and silicon oxide are preferred ones.

The fine organic hollow particles as the first layer in the present invention are effective when they are coated in a coverage of 1 g/m$^2$ or more. However, if the hollow particles are coated in an excessively large amount, properties as paper are rather injured than improving that of thermosensitive. For example, as the coated layer is thickened, the base paper is thinned to make its whole thickness even. This would result in a problem of flexural rigidity. A coverage of 3 to 15 g/m$^2$ is thus preferred. In order to exhibit the function as the second layer without injuring the effect of the first layer, a coverage of 1 to 10 g/m$^2$ of oil-absorbing inorganic pigment of the second layer is most preferred. Where a coverage in the second layer is large, the thermal transfer becomes poor so that the heat insulating properties and elasticity of the first layer are not sufficiently utilizable in some occasion.

By providing a thermosensitive layer on the thus provided undercoat layer, desired properties can be obtained.

Dye precursors used in the present invention are not particularly limited so long as they are generally used for pressure-sensitive recording paper or thermosensitive recording paper. Specific examples include the following dye precursors.

(1) Triarylmethane compounds 3,3-bis(p-dimethylaminophenyl)-6-dimethylaminophthalide (Crystal Violet lactone), 3,3-bis(p-dimethylaminophenyl)phthalide, 3-(p-dimethylaminophenyl)-3-(1,2-dimethylindol-3-yl)-phthalide, 3-(p-dimethylaminophenyl)-3-(2-methylindol-3-yl)-phthalide, 3-(p-dimethylaminophenyl)-3-(2-phenylindol-3 yl)-phthalide, 3,3-bis(1,2-dimethyl-indol-3-yl)-5-dimethylaminophthalide, 3,3-bis(1,2-dimethylindol-3-yl)-6-dimethyaminophthalide, 3,3-bis(9-ethylcarbazol-3-yl)-5-dimethylaminophthalide, 3,3-bis(2-phenylindol-3-yl)-5-dimethylaminophthalide, 3-p-dimethylaminophenyl-3-(1-methylpyrrol-2-yl)-6-dimethylaminophthalide, etc.

(2) Diphenylmethane compounds 4,4'-bis-dimethylaminophenyl benzhydryl benzyl ether, N-halophenyl leuco Auramine, N-2,4,5-trichlorophenyl leuco Auramine, etc.

(3) Xanthene compounds

Rhodamine B anilinolactam, Rhodamine B p-chloroanilinolactam, 3-diethylamino-7-dibenzylaminofluorane, 3-diethylamino-7-octylaminofluorane, 3-diethylamino-7-phenylfluorane, 3-diethylamino-7-chlorofluorane, , 3-diethylamino-6-chloro-7-methylfluorane, 3-diethylamino-7-(3,4-dichloroanilino)fluorane, 3-diethylamino-7-(2-chloroanilino)fluorane, 3-diethylamino-6-methyl-7-anilinofluorane, 3-(N-ethyl-N-tolyl)amino-6-methyl-7-phenethylfluorane, 3-diethylamino-7-(4-nitroanilino)fluorane, 3-dibutylamino-6-methyl-7-anilinofluorane, 3-(N-methyl-N-propyl)amino-6-methyl-7-anilinofluorane, 3-(N-ethyl-N-isoamyl)amino-6-methyl-7-anilinofluorane, 3-(N-methyl-N-cyclohexyl-)amino-6-methyl-7-anilinofluorane, 3-(N-ethyl-N-tetrahydrofuryl)amino-6-methyl-7-anilinofluorane, etc.

(4) Thiazine compounds benzoyl leuco methylene blue, p-nitrobenzoyl leuco methylene blue, etc.

(5) Spiro compounds 3-methyl-spiro-dinaphthopyran, 3-ethyl-spirodinaphthopyran, 3,3'-dichloro-spiro-dinaphthopyran, 3-benzyl-spiro-dinaphthopyran, 3-methylnaphtho-(3-methoxybenzo)spiro-pyran, 3-propyl-spiro-benzopyran, etc. These dye precursors can be used singly or as admixtures of two ore more.

As dye developers used in the present invention, electron accepting compounds generally employed for thermosensitive paper are used; in particular, phenol derivatives, aromatic carboxylic acid derivatives or metal compounds thereof, N,N'-diarylthiourea derivatives, etc. are used. Among them, particularly preferred ones are phenol derivatives. Specific examples are p-phenylphenol, p-hydroxyacetophenone, 4-hydroxy-4'-methyldiphenylsulfone, 4-hydroxy-4'-isopropoxydiphenylsulfone, 4-hydroxy-4'-benzenesulfonyloxydiphenylsulfone, 1,1-bis(p-hydroxyphenyl)propane, 1,1-bis(p-hydroxyphenyl)pentane, 1,1-bis(p-hydroxyphenyl)hexane, 1,1-bis(p-hydroxyphenyl)cyclohexane, 2,2-bis(p-hydroxyphenyl)propane, 2,2-bis(p-hydroxyphenyl)butane, 2,2-bis(p-hydroxyphenyl)hexane, 1,1-bis(p-hydroxyphenyl)-2-ethylhexane, 2,2-bis(3-chloro-4-hydroxyphenyl)propane, 1,1-bis(p-hydroxyphenyl)-1-phenylethane, 1,3-di[2-(p-hydroxyphenyl)-2-propyl]-benzene, 1,3-di[2-(3,4-dihydroxyphenyl)-2-propyl]benzene, 1,4-di[2-(p-hydroxyphenyl)-2-propyl]benzene, 4,4'-dihydroxydiphenyl ether, 4,4'-dihydroxydiphenylsulfone, 3,3'-dichloro-4,4'-dihydroxydiphenylsulfone, 3,3'-diallyl-4,4'-dihydroxydiphenylsulfone, 3,3'-dichloro-4,4'-dihydroxydiphenylsulfide, methyl 2,2-bis(4-hydroxyphenyl)acetate, butyl 2,2-bis(4-hydroxyphenyl)acetate, 4,4'-thiobis(2-t-butyl-5-methylphenol), bis(3-allyl-4-hydroxyphenyl)sulfone, 4-hydroxy-4'-isopropyloxydiphenylsulfone, 3,4-dihydroxy-4'-methyldiphenylsulfone, benzyl p-hydroxybenzoate, chlorobenzyl p-hydroxybenzoate, propyl p-hydroxybenzoate, butyl p-hydroxybenzoate, dimethyl 4-hydroxyphthalate, benzyl gallate, stearyl gallate, salicylanilide, 5-chlorosalicylanilide, etc.

In addition, the thermosensitive layer may also contain as pigments diatomaceous earth, talc, kaolin, calcined kaolin, calcium carbonate, magnesium carbonate, titanium oxide, zinc oxide, silicon oxide, aluminum hydroxide, urea-formalin resin, etc.; may further contain waxes such as N-hydroxymethylstearic amide, stearic amide, palmitic amide, etc.; naphthol derivatives such as 2-benzyloxynaphthalene, etc.; biphenyl derivatives such as p-benzylbiphenyl, 4-allyloxybiphenyl, etc.; polyether compounds such as 1,2-bis(3-methylphenoxy)ethane, 2,2'-bis(4-methoxyphenoxy)diethyl ether, bis(4-methoxyphenyl) ether, etc.; carbonate or oxalate diester derivatives such as diphenyl carbonate, dibenzyl oxalate, di(p-fluorobenzyl) oxalate, etc. for purposes of further improving the sensitivity.

In addition, there may be incorporated, for purposes of preventing head abrasion, prevention of sticking, etc., higher fatty acid metal salts such as zinc stearate, calcium stearate, etc.; waxes such as paraffin, oxidized paraffin, polyethylene, oxidized polyethylene, stearic amide, castor wax, etc.; dispersing agents such as sodium dioctylsulfosuccinate, etc.; UV absorbing agents of benzophenone type, benzotriazole type, etc. and further surface active agents, fluorescent dyes, etc., if necessary and desired.

In the present invention, as adhesives used for the first undercoat layer, second undercoat layer and thermosensitive recording layer used in the present invention, various adhesives generally used are usable. Examples of the adhesives include water soluble adhesives such as starches, hydroxyethyl cellulose, methyl cellulose, carboxymethyl cellulose, gelatin, casein, polyvinyl alcohol, modified polyvinyl alcohol, sodium polyacrylate, acrylic amide/acrylate copolymer, acrylamide/acrylate/methacrylate ternary copolymer, alkali salts of styrene/maleic anhydride copolymer, alkali salts of ethylene/maleic anhydride copolymer, etc.; latexes such as polyvinyl acetate, polyurethane, polyacrylates, styrene/butadiene copolymer, acrylonitrile/butadiene copolymer, methyl acrylate/butadiene copolymer, ethylene/vinyl acetate copolymer, etc. As the support used in the present invention, paper is mainly used. Non-woven cloth, a plastic film, synthetic paper, metal foil and the like or a composite sheet obtained by combining them may optionally be employed.

EXAMPLES

Next, the present invention will be described in more detail by referring to the examples.

Parts and % shown below are all by weight. Numeral values representing coated amounts or coverages are dry weights, unless indicated.

EXAMPLE 1

(1) Preparation of Suspension A (coating liquid for the first layer)

A mixture having the following composition was stirred to prepare a coating liquid for the first layer.

| | |
|---|---|
| Fine organic hollow particle emulsion composed of styrene-acryl copolymer resin (ROPAQUE OP-62 made by Rohm & Haas; solid content: 37.5%, particle diameter: about 0.4 μm, wall thickness: 0.05–0.06 μm) | 200 parts |
| Styrene-butadiene copolymer latex (50% aqueous dispersion) | 30 parts |
| Water | 20 parts |

(2) Preparation of Suspension B (coating liquid for the second layer)

A mixture having the following composition was stirred to prepare a coating liquid for the second layer.

| | |
|---|---|
| ANSILEX (calcined kaolin, made by Engelhardt Co., Ltd.) | 100 parts |
| Styrene-butadiene copolymer latex (50% aqueous dispersion) | 24 parts |
| MS 4600 (phosphated starch, 10% aqueous solution, made by Nippon Shokuhin K.K.) | 60 parts |
| Water | 52 parts |

(3) Preparation of Thermosensitive Suspension

A mixture having the following composition was ground into a mean grain diameter of about 1 μm with a sand grinder to prepare [Suspension C] and [Suspension D], respectively.

| | |
|---|---|
| [Suspension C] | |
| 3-dibutylamino-6-methyl-7-anilinofluorane | 40 parts |
| 10% Polyvinyl alcohol aqueous solution | 20 parts |
| Water | 40 parts |
| [Suspension D] | |
| Bisphenol A | 50 parts |
| Benzyloxynaphthalene | 50 parts |
| 10% Polyvinyl alcohol aqueous solution | 50 parts |
| Water | 100 parts |

Then, a thermosensitive suspension was prepared in the following formulation, using the thus prepared [Suspension C] and [Suspension D].

| | |
|---|---|
| [Suspension C] | 50 parts |
| [Suspension D] | 250 parts |
| Zinc stearate (40% dispersion) | 25 parts |
| 10% Polyvinyl alcohol aqueous solution | 216 parts |
| Calcium carbonate | 50 parts |
| Water | 417 parts |

Each of the thus prepared coating suspensions was coated onto a base paper weighing 40 g/m$^2$ in the following coverages with a Mayor bar to prepare a thermosensitive recording material.

| | |
|---|---|
| First layer | 8 g/m$^2$ |
| Second layer | 3 g/m$^2$ |
| Thermosensitive layer | 5.5 g/m$^2$ |

EXAMPLE 2

After the suspension for the first layer was coated in a coverage of 8 g/m$^2$ in Example 1, the suspension for thermosensitive layer was directly coated thereon in a manner similar to Example 1, without providing the suspension for the second layer. Thus, a thermosensitive recording material was prepared.

EXAMPLE 3

A thermosensitive recording material was prepared in a manner similar to Example 1 except that 100 parts of Ultra White 90 (kaolin for the purpose of coating, made by Engelhardt Co.) were used instead of 100 parts of ANSILEX in the preparation of Suspension B (coating liquid for the second layer) in Example 1.

COMPARATIVE EXAMPLE 1

A thermosensitive recording material for the comparative study was prepared in a manner similar to Example 1 except that a mixture having the following composition was prepared and coated in a coverage of 8 g/m$^2$ as the coating liquid for the first layer, instead of [Suspension A] in Example 1.

| | |
|---|---|
| Fine organic hollow particle emulsion composed of styrene-acryl copolymer resin (VONCOAT PP-1100 made by Dainippon Ink Co.; solid content: 36.5%, particle diameter: about 0.55–0.60 μm, wall thickness: 0.11–0.12 μm) | 200 parts |
| Styrene-butadiene copolymer latex (50% aqueous dispersion) | 29 parts |
| Water | 14 parts |

COMPARATIVE EXAMPLE 2

A thermosensitive recording material for the comparative study was prepared by directly coating the coating liquid for the second layer onto base paper in a coverage of 8 g/m$^2$, without coating the coating liquid for the first layer, both prepared in Example 1, and coating a thermosensitive coating liquid thereon in a coverage of 5.5 g/m$^2$.

COMPARATIVE EXAMPLE 3

A thermosensitive recording material for the comparative study was prepared in a manner similar to Example 1 except that the thermosensitive coating liquid was directly coated onto a base paper weighing 40 g/m$^2$, in a coverage of 5.5 g/m$^2$, without coating the coating liquid for the first layer nor that for the second layer, both prepared in Example 1.

The thus prepared thermosensitive recording materials were treated by supercalendering so as to have them complied with a Beck's degree of smoothness varied between 400 and 500 seconds. And these materials were compared with respect to recording density, printability and degree of adhering tailings or foreign matters using a GIII facsimile test machine. A test machine was (TH-PMD) manufactured by Okura Electric Co., Ltd. Printing was performed using a thermal head showing its dot density of 8 dots/mm and its head resistance of 185 ohm, at a head voltage of 15 V, for its load time of 0.08 ms and 0.10 ms. Recording density was measured with Macbeth RD-918 reflection densitometer. These results are shown in Table 1.

TABLE 1

| | | Sensitivity 0.08 ms | Sensitivity 0.10 ms | Printability | Tailings |
|---|---|---|---|---|---|
| Example | 1 | 0.55 | 1.05 | o | o |
| | 2 | 0.52 | 0.88 | o–Δ | o–Δ |
| | 3 | 0.51 | 0.91 | o | o–Δ |
| Comparative Example | 1 | 0.40 | 0.79 | Δ | o |
| | 2 | 0.33 | 0.71 | Δ | o |
| | 3 | 0.15 | 0.44 | x | x |

o: Good
o–Δ: Relatively good
Δ: No good
x: Bad

As is evident from the results of Table 1, the thermosensitive recording materials of the present invention, wherein the thermosensitive layer was coated onto the undercoat layer bearing a coated layer composed of fine organic hollow particles having a ratio of its wall thickness to its particle diameter being 0.15 or less, were excellent in thermal response, as compared to conventional thermosensitive recording materials and could achieve improved sensitivity and improved dot reproducibility. It was further noted that by providing the coated layer composed of oil-absorbing inorganic pigments between the hollow particle layer and the thermosensitive layer, improved sensitivity and improved dot reproducibility could be achieved, without increasing foreign matters adhered to the head.

While the invention has been described in detail and with reference to specific embodiments thereof, it is apparent to one skilled in the art that various changes and modifications can be made therein without departing from the spirit and the scope of the present invention.

What is claimed is:

1. A thermosensitive recording material comprising a support having provided thereon a thermosensitive recording layer comprising a dye precursor and a color developer capable of developing a color of said dye precursor upon heating and an undercoat layer comprising fine organic hollow particles having a ratio of wall thickness to particle diameter 0.15 or less.

2. A thermosensitive recording material of claim 1, wherein a second undercoat layer comprising an oil-absorbing inorganic pigment is provided between said undercoat layer comprising the fine organic hollow particles and said thermosensitive layer.

3. A thermosensitive recording material of claim 2, wherein said fine organic hollow particles are one member selected from the group consisting of styrene resin, acryl resin and styrene-acryl copolymer resin.

4. A thermosensitive recording material of claim 3, wherein the coverage of said fine organic hollow particles is at least 1 g/m$^2$.

5. A thermosensitive recording material of claim 4, wherein said coverage is 3 to 15 g/m$^2$.

6. A thermosensitive recording material of claim 2, wherein-an oil absorbing amount of the oil-absorbing inorganic pigment used as said second undercoat layer is at least 70 ml/100 g.

7. A thermosensitive recording material of claim 2, wherein the coverage of said oil-absorbing inorganic pigment is 1 to 10 g/m$^2$.

8. A thermosensitive recording material of claim 2, wherein pigments are incorporated into said undercoat layer comprising the fine organic hollow particles.

* * * * *